United States Patent [19]

Amici et al.

[11] Patent Number: 4,630,756

[45] Date of Patent: Dec. 23, 1986

[54] LIQUID SQUIRTING CREATURE

[75] Inventors: Francis R. Amici, Northford; Richard I. Farrington, New Britain; Pietro Piazza, Prospect, all of Conn.

[73] Assignee: Coleco Industries, Inc., West Hartford, Conn.

[21] Appl. No.: 700,395

[22] Filed: Feb. 11, 1985

[51] Int. Cl.[4] ..... A63H 3/24

[52] U.S. Cl. ..... 222/78; 222/206; 222/211; 446/183; 446/197; 446/475; D9/318

[58] Field of Search ..... D9/310, 318; 222/206, 222/211, 215, 173, 78; 446/183, 197, 475, 483

[56] References Cited

U.S. PATENT DOCUMENTS

| | | | |
|---|---|---|---|
| 1,266,106 | 5/1918 | Coup . | |
| 1,560,909 | 11/1925 | Gill . | |
| 2,531,745 | 11/1950 | Schopmeyer | 222/211 X |
| 2,678,516 | 5/1954 | Graham | 46/117 |
| 2,705,090 | 3/1955 | Odermatt-Wehrli | 222/78 |
| 2,799,434 | 7/1957 | Malko | 222/211 |
| 2,826,859 | 3/1958 | Shaffer . | |
| 2,827,734 | 3/1958 | Beebe | 46/135 |
| 3,353,823 | 11/1967 | Sobel . | |

*Primary Examiner*—Joseph J. Rolla
*Assistant Examiner*—P. McCoy Smith

[57] ABSTRACT

A liquid squirting simulated creature is comprised of a front section having a body, legs and head, and a rear section which is assembled thereto. The front section is comprised of top and bottom elements defining a cavity therebetween and front and rear apertures, as well as apertures extending along the sides thereof through which a multiplicity of legs extend. The rear section is a resiliently compressible bulbous member providing a chamber therewithin to contain fluid and having a neck portion extending through the aperture in the rear wall of the front section. A tubular conduit is seated in an opening in the neck portion of the rear section and extends to a front aperture in the front section so as to provide the conduit for discharge of fluid from the chamber therethrough. The leg members are comprised of a web on each side interconnecting a multiplicity of legs on that side of the front section, and flexible portions which extend through apertures along the sides of the front section.

5 Claims, 3 Drawing Figures

LIQUID SQUIRTING CREATURE

BACKGROUND OF THE INVENTION

Various toy structures have been described in the literature in which a flexible bulbous member provides a cavity which communicates with the exterior of the structure. This cavity is filled with water or other liquid and, when the structure is squeezed about the bulbous portion, the liquid is expelled through the aperture provided. This concept has been employed in simulated figure toys and in various other types of toy articles In some instances, the bulb which contains the liquid and which is to be compressed to expel the liquid, is formed separately from the remainder of the structure and is disposed in a fashion so that it can be accessed to apply the compressing pressure. In some instances, the bulb is disposed within the structure and is mechanically actuated so as to expel the liquid contained therein.

It is an object of the present invention to provide a novel simulated creature comprised of relatively few components and in which the compressible bulb portion forms a portion of the simulated creature.

It is also an object to provide such a creature in which the elements may be fabricated readily and assembled quickly into a relatively durable assembly.

Another object to is provide such a creature which may be fabricated at relatively low cost and which is readily adaptable to variations in appearance by changing the molded portions used to fabricate its components.

SUMMARY OF THE INVENTION

It has now been found that the foregoing and related objects may be readily attained in a liquid-squirting simulated creature which comprises a front member simulating a head, a torso and legs. The front section also defines a cavity therewithin and has a rear wall with an aperture extending therethrough and a nozzle aperture in its head. A rear member of resiliently deflectable resin simulates a portion of the creature's body and defines a chamber therewithin. This rear member has a neck portion extending through the aperture of the rear wall of the front member and into the cavity therewithin, and the neck portion has a passage therethrough which extends outwardly from the chamber therewithin. A tubular conduit having one end seated in passage of the neck portion of the rear member extends therefrom to the nozzle aperture in the head. Thus, compression of the rear member will cause fluid contained within the chamber to be expelled through the conduit and thence through the nozzle aperture in the head.

In the preferred assembly, the front member is comprised of top and bottom elements joined together along transversely disposed abutting surfaces and each defining a portion of the aperture in the rear wall. The rear member neck portion has an enlarged outer end portion with the neck portion being captured between the elements of the front member upon assembly thereon. The front member also includes a tubular nozzle element simulating a proboscis which is captured between the top and bottom elements and the nozzle aperture is provided thereby.

Most desirably, the legs extend outwardly from the cavity of the front member and those on each side of the front member are joined by a common web portion disposed in the cavity. As indicated previously, the front member is desirably comprised of top and bottom elements which are joined together, and the web portions and legs are captured between these top and bottom elements.

DETAILED DESCRIPTION OF THE ILLUSTRATED EMBODIMENT

Figure 1:
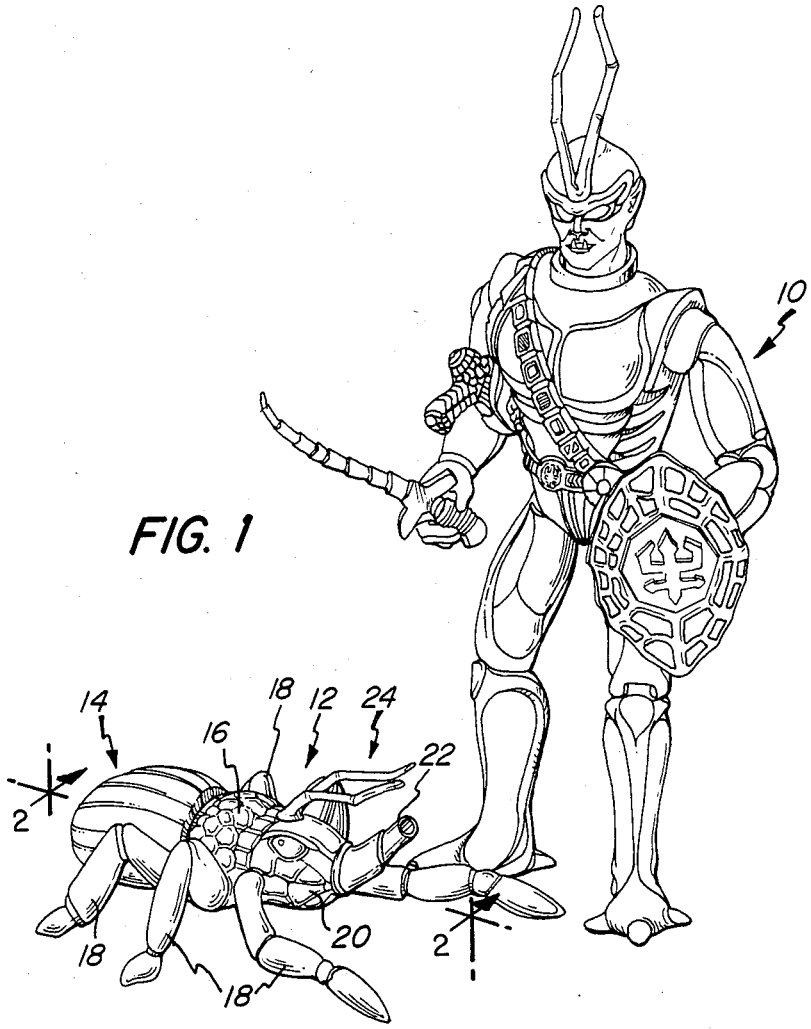
FIG. 1 is a perspective view of a liquid-squirting simulated creature embodying the present invention as well as a humanoid associated therewith.

Turning first to FIG. 1 of the attached drawings, therein illustrated is a liquid squirting simulated creature embodying the present invention in association with a humanoid generally designated by the numeral 10. The creature is comprised of a front section generally designated by the numeral 12 and a rear section generally designated by the numeral 14. The front section has a torso 16, legs 18 extending outwardly therefrom, a head 20 with a proboscis generally designated by the numeral 22 extending forwardly therefrom and an antennae member generally designated by the numeral 24 and extending outwardly from the upper portion thereof.

Figure 2:
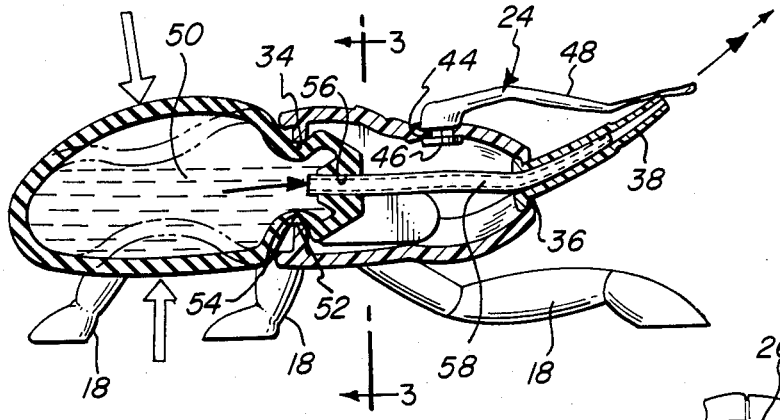
FIG. 2 is a longitudinal sectional view of the creature along the line 2—2 of FIG. 1 and drawn to an enlarged scale.
Figure 3:
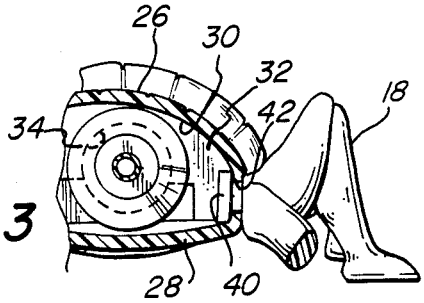
FIG. 3 is a fragmentary sectional view along the line 3—3 of FIG. 2.

Turning now to FIGS. 2 and 3, the front section 12 is comprised of top element 26 and bottom element 28 which abut along transversely extending surfaces and define a cavity 30 therebetween. The elements 26,28 together define a rear wall 32 with a generally circular aperture 34 extending therethrough, and a front aperture 36 in the head 20 in which is seated the proboscis 22. The top and bottom elements 26,28 also define generally circular apertures 42 at spaced points along the length of the body 16. As best seen in FIG. 3, legs 18 are formed as elements of a continuous leg assembly which includes the web portion 40 disposed inwardly of the cavity in the body 16 and extending between the legs 18. The legs extend outwardly through the circular apertures 42 defined between the top and bottom elements 26,28.

As seen in FIG. 2, the proboscis 22 has an enlarged base portion abutting the wall of the head about the aperture 36 and the elongated nozzle portion 38 which simulates the proboscis and which has the discharge passage extending therethrough.

Turning now in detail to the rear section 14, it is best seen in FIG. 2 and comprises a hollow member providing a chamber 50 therewithin and a neck 52 of generally circular cross-section with a reduced portion 54 and a opening or passage 56 extending therethrough. The neck 52 extends through the aperture 34 in the rear wall 32 so that the principal portion thereof is disposed within the cavity defined by the front section 12. An elongated tube 58 is seated in the neck opening 56 and provides a conduit between the chamber 50 and the passage through the elongated element 38 of the proboscis 22.

As also seen in FIG. 2, the head 20 has an aperture in the upper portion thereof, and the antennae structure 24 has a base portion 46 abutting the inside wall of the head 20 and extending therethrough, with the bifurcated antennae elements 48 extending outwardly therefrom.

In assembling the simulated creature, the leg assemblies are introduced into the two sides of the bottom element 28 so that the legs 18 extend outwardly through the semicircular apertures 42 provided by the bottom element 28 and the leg web 40 is snugly disposed against the inside wall. The tube 58 is seated in the opening 56 of the rear section 14 and its opposite end is seated in the passage within the proboscis 22. This assembly is then placed in the portions of the apertures 34,36 defined in the front section 12, and then the upper element 26 is brought down thereover to clamp the components in place, and the two elements 26,28 are then bonded together.

Prior to assembly of the top element 26, the antennae structure 24 is mounted therein by passing the bifurcated elements 48 through the aperture 44 in the head portion 20 until the base 46 seats tightly against the inside wall.

As will be readily appreciated, the various elements of the structure are fabricated from synthetic resin and may be bonded to each other as required by separate adhesive or by providing interfacial bonding such as by ultrasonic welding. The elements 26,28 of the front section will generally be fabricated from a relatively rigid resin whereas the legs 18 and the rear section 14 will be fabricated from relatively resiliently deflectable material so as to permit the compression of the rear section 14 and the movement of the legs 18 into desired positions.

In play action involving the creature of the present invention, the proboscis is placed in a body of liquid such as water, and the bulb compressed to expel air and produce a vacuum as it is allowed to expand, thus sucking the liquid into the chamber 50. Thereafter, compression of the rear section 14 will expel fluid 50 from the chamber 50 through the tube 58 and out through the proboscis 22 as indicated by the arrows in FIG. 2.

Thus, it can be seen from the foregoing detailed specification and attached drawings that the present invention provides a novel liquid squirting creature which can readily be varied in appearance by alteration of the appearance of one or both principal elements which provide the overall appearance. The elements may be fabricated relatively economically and readily from synthetic resin, and may be readily assembled to provide a attractive composite structure simulating various types of creatures. By use of the multiple components indicated, the resins may be selected so as to provide a relatively long lived assembly.

Having thus described the invention, what is claimed is:

1. A liquid-squirting simulated creature comprising:

(a) a front member integrally formed of relatively rigid synthetic resin simulating a creature's head portion at its forward end portion and a creature's torso portion at its rearward end portion, said front member torso portion having a sidewall extending rearwardly from said head portion and a rear wall extending transversely inwardly from said sidewall adjacent the rearward end thereof to define a cavity therewithin, said rear wall having an aperture extending therethrough and said head portion having a nozzle aperture;

(b) a seperately formed rear member integrally formed of resiliently deflectable resin with a body portion simulating the rearward portion of the creature's body and a neck portion, said body portion and neck portion defining a chamber therewithin, said neck portion extending through said aperture of said rear wall of said front member and into said cavity therewithin, said neck cavity extending forwardly of said rear wall towards said head portion with its forward end spaced forwardly of said rear wall, said neck portion having a passage therethrough extending outwardly from said chamber providing the only aperture from said chamber, said rear wall of said front member engaging said neck portion of said rear member adjacent its rearward end;

(c) a tubular conduit having one end supported in said passage of said neck portion, said neck portion providing integrally formed sealing means at its forward end sealingly engaged with said conduit forwardly of said rear wall of said front member and extending therefrom to said nozzle aperture in said head, said conduit being imperforate along its length and open only at its ends at said nozzle aperture and said neck portion passage, whereby fluid may be drawn into an expelled from said chamber by compression of said rear member.

2. The liquid squirting creature of claim 1 wherein said front member is comprised of top and bottom elements joined together along transversely plane disposed abutting surfaces each defining a portion of said aperture in said rear wall, said rear member neck portion having an enlarged outer end portion with said neck portion being captured between said elements upon assembly thereof.

3. The liquid squirting creature of claim 2 wherein said front member includes a tubular nozzle element simulating a proboscis captured between said top and bottom elements and said nozzle aperture is provided in the forward end of said nozzle element.

4. The liquid squirting creature of claim 3 wherein said legs extend outwardly from said cavity of said front member and those on each side of said front member are joined by a common web portion in said cavity.

5. The liquid squirting creature of claim 4 wherein said web portion and legs are captured between said top and bottom elements.

* * * * *